US011414310B2

(12) United States Patent
Cowden

(10) Patent No.: US 11,414,310 B2
(45) Date of Patent: Aug. 16, 2022

(54) CABINET LIFTING ASSEMBLY

(71) Applicant: Jay Cowden, Spokane, WA (US)

(72) Inventor: Jay Cowden, Spokane, WA (US)

( * ) Notice: Subject to any disclaimer, the term of this patent is extended or adjusted under 35 U.S.C. 154(b) by 485 days.

(21) Appl. No.: 16/553,816

(22) Filed: Aug. 28, 2019

(65) Prior Publication Data

US 2021/0061627 A1 Mar. 4, 2021

(51) Int. Cl.
*B66F 3/12* (2006.01)
*B66F 7/06* (2006.01)

(52) U.S. Cl.
CPC ..... *B66F 3/12* (2013.01); *B66F 7/065* (2013.01)

(58) Field of Classification Search
CPC .. B66F 3/12; B66F 15/00; B66F 7/065; B66F 3/22; B66F 7/0608; A47B 96/06; E04F 21/18; E04F 21/1827; E04F 11/066; E04F 21/1805
USPC .... 254/120, 122, 123, 124, 126; 414/10, 11, 414/12
See application file for complete search history.

(56) References Cited

U.S. PATENT DOCUMENTS

| | | | | |
|---|---|---|---|---|
| 5,169,219 | A | 12/1992 | Obbink | |
| 5,322,403 | A | 6/1994 | Herde | |
| 5,377,782 | A * | 1/1995 | Francis | B66F 7/28 187/217 |
| 5,609,332 | A | 3/1997 | Hassell | |
| 5,645,272 | A * | 7/1997 | Brennan, Sr. | B25H 1/00 269/68 |
| 5,950,990 | A | 9/1999 | Castillo | |
| 6,273,662 | B1 | 8/2001 | Fleckenstein | |
| 6,929,250 | B2 * | 8/2005 | Blake | B66F 9/07 254/122 |
| 7,112,026 | B1 | 9/2006 | Foster | |
| D668,425 | S | 10/2012 | Swasey | |
| 2006/0180403 | A1 | 8/2006 | Hanlon | |
| 2008/0048161 | A1 * | 2/2008 | Meyer | B66F 3/12 254/2 R |

* cited by examiner

*Primary Examiner* — Gregory W Adams

(57) ABSTRACT

A cabinet lifting assembly for lifting overhead cabinets for installation includes a scissor lift that is positionable between a lifted position and a lowered position. The scissor lift includes a base, a top, a pair of scissors and a screw extending between the scissors. A fitting is coupled to the screw to be engaged by a chuck on a drill thereby facilitating the screw to be rotated in the first direction or the second direction. A panel is coupled to the top of the scissor lift. A support is coupled to the panel such to have an overhead cabinet positioned thereon thereby facilitating the scissor lift to lift and lower the overhead cabinet for installation.

4 Claims, 4 Drawing Sheets

CABINET LIFTING ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to lifting devices and more particularly pertains to a new lifting device for lifting overhead cabinets for installation.

(2) Description of Related Art Including Information Disclosed Under 37 CFR 1.97 and 1.98

The prior art relates to lifting devices.

BRIEF SUMMARY OF THE INVENTION

An embodiment of the disclosure meets the needs presented above by generally comprising a scissor lift that is positionable between a lifted position and a lowered position. The scissor lift includes a base, a top, a pair of scissors and a screw extending between the scissors. A fitting is coupled to the screw to be engaged by a chuck on a drill thereby facilitating the screw to be rotated in the first direction or the second direction. A panel is coupled to the top of the scissor lift. A support is coupled to the panel such to have an overhead cabinet positioned thereon thereby facilitating the scissor lift to lift and lower the overhead cabinet for installation.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
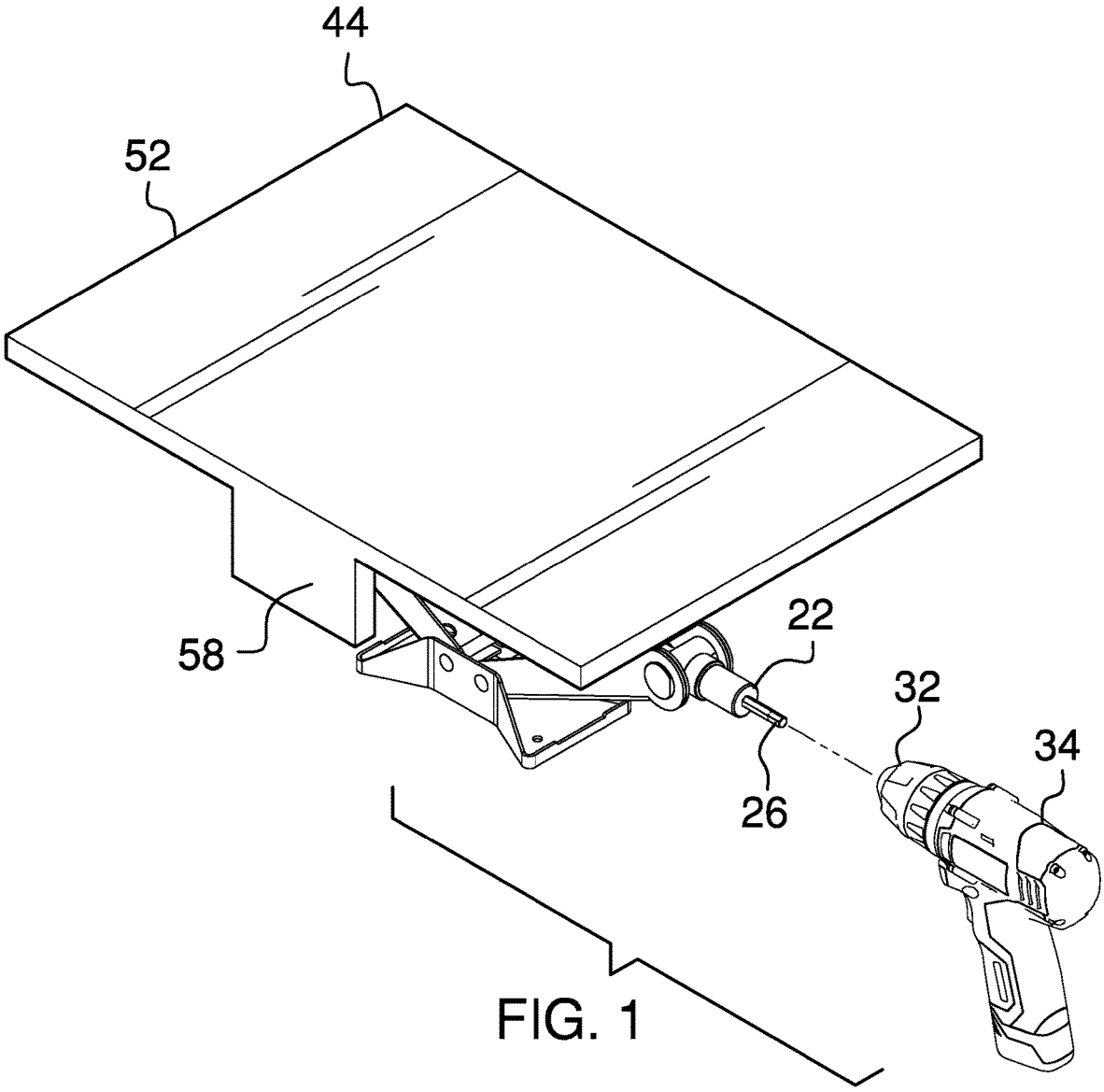
FIG. 1 is a perspective view of a cabinet lifting assembly according to an embodiment of the disclosure.
Figure 2:
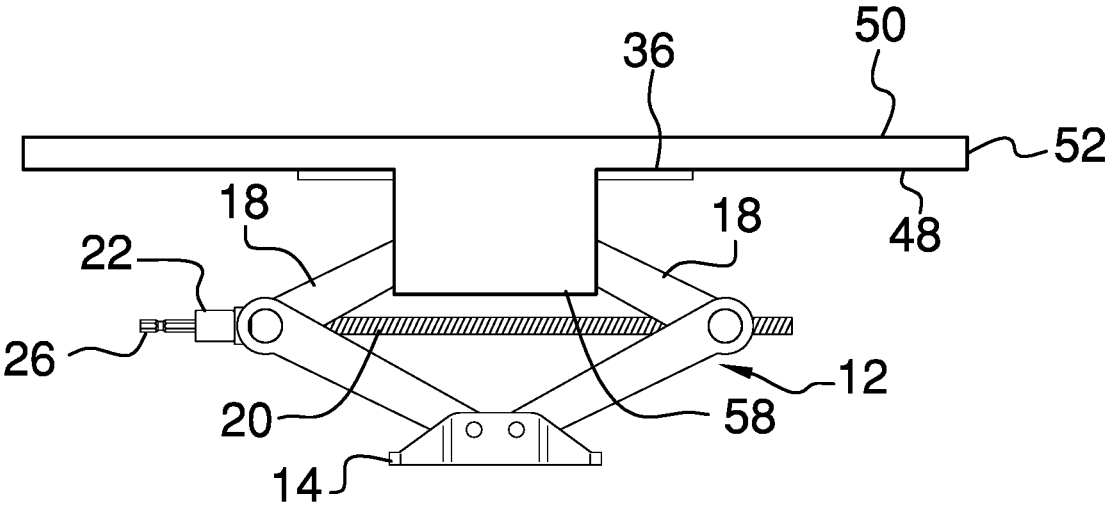
FIG. 2 is a front view of an embodiment of the disclosure.
Figure 3:
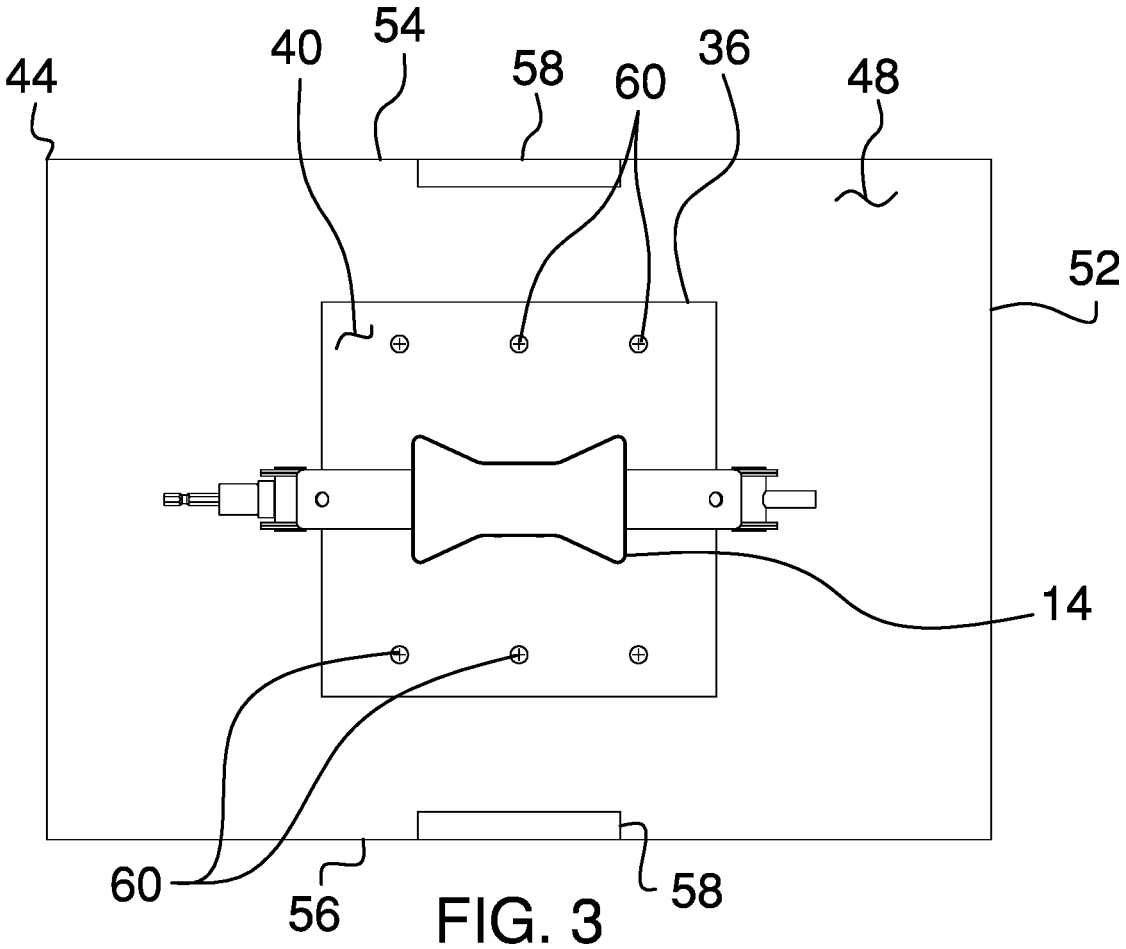
FIG. 3 is a bottom view of an embodiment of the disclosure.
Figure 4:
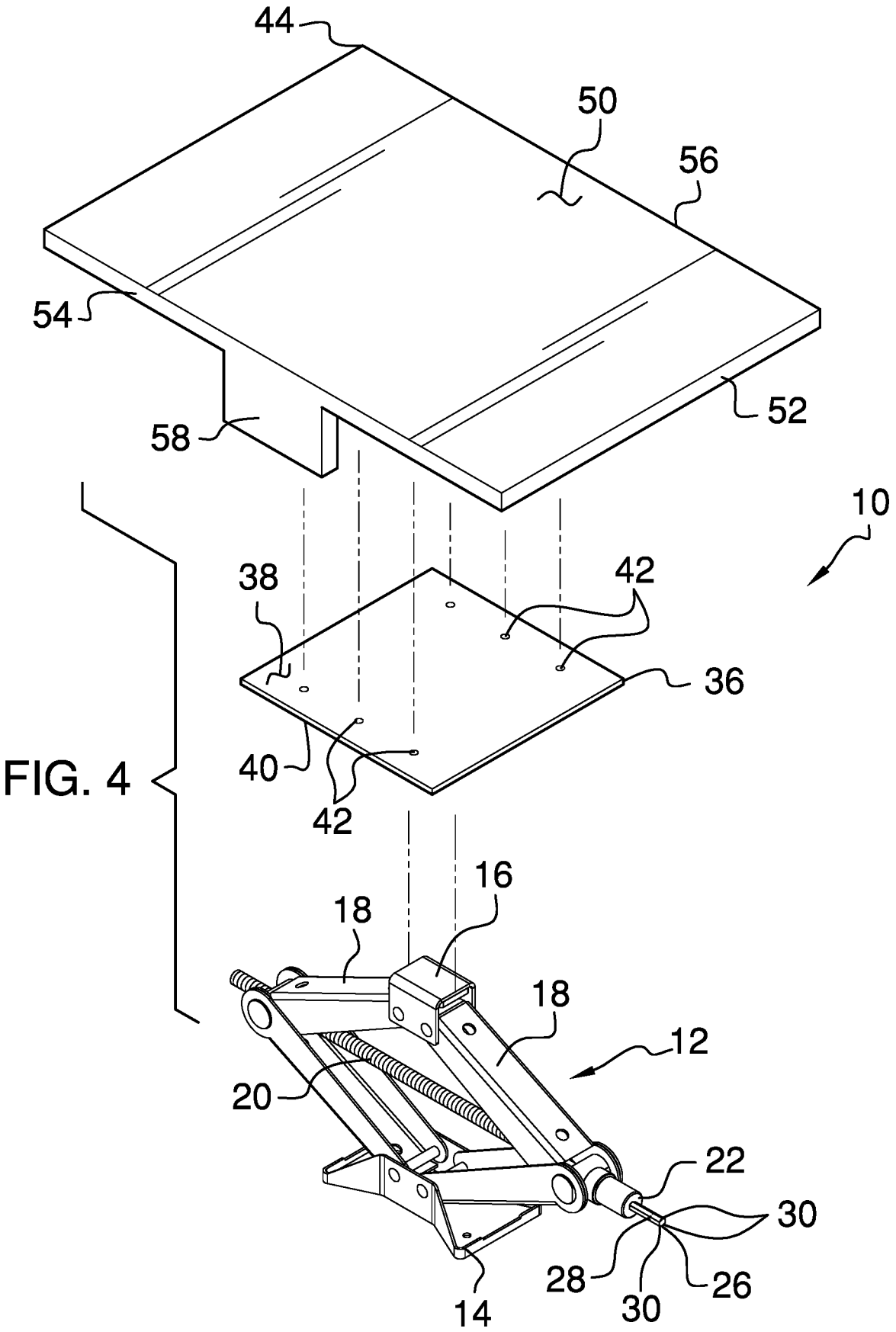
FIG. 4 is an exploded perspective view of an embodiment of the disclosure.
Figure 5:
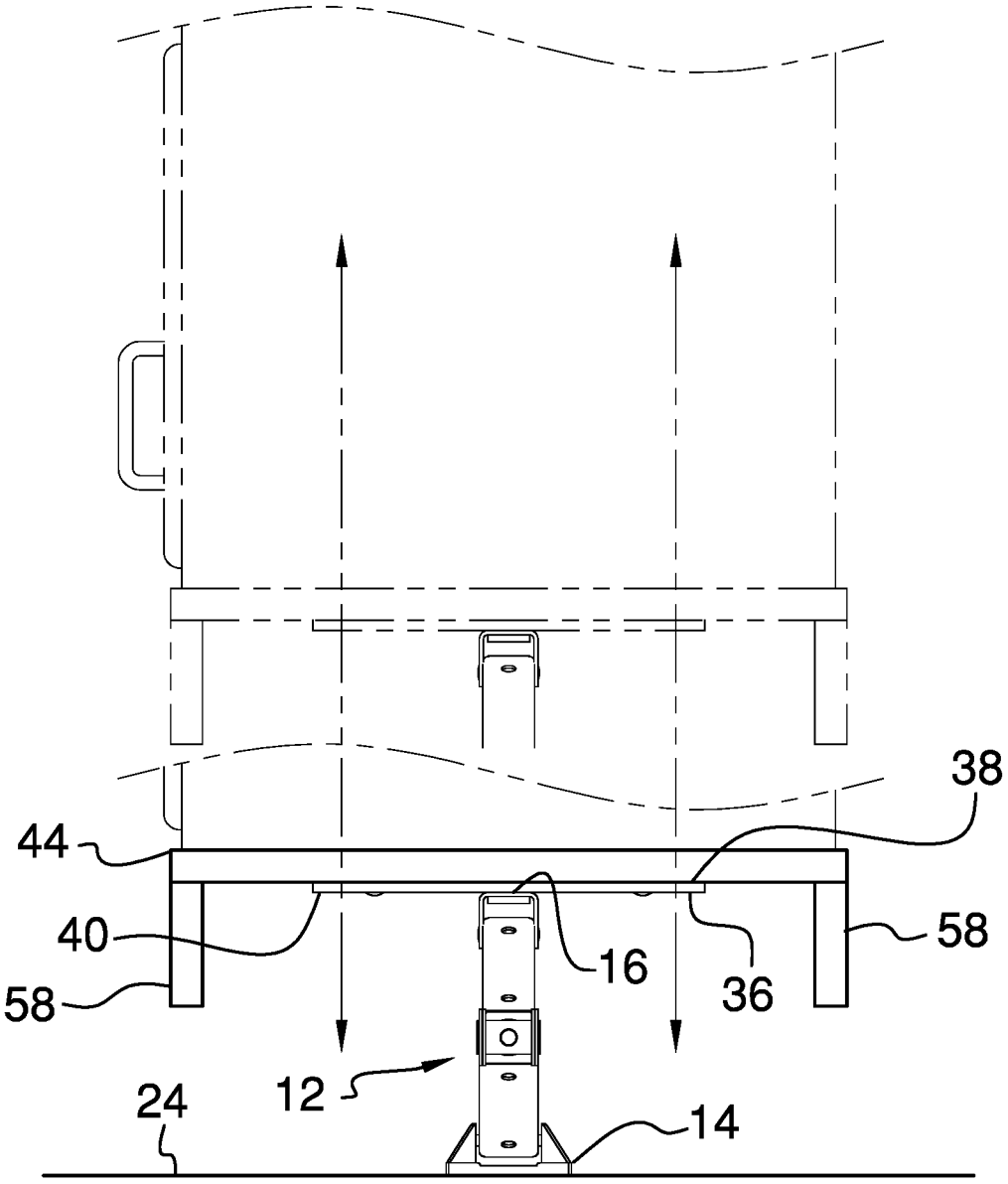
FIG. 5 is a perspective in-use view of an embodiment of the disclosure.

With reference now to the drawings, and in particular to FIGS. 1 through 5 thereof, a new lifting device embodying the principles and concepts of an embodiment of the disclosure and generally designated by the reference numeral 10 will be described.

As best illustrated in FIGS. 1 through 5, the cabinet lifting assembly 10 generally comprises a scissor lift 12 that is positionable between a lifted position and a lowered position. The scissor lift 12 includes a base 14, a top end 16, a pair of scissors 18 and a screw 20 extending between the scissors 18. Each of the scissors 18 extends between the base 14 and the top end 16. The screw 20 is rotatable in a first direction to urge the scissor lift 12 into the lifted position having the top end 16 being spaced a maximum distance from the base 14. The screw 20 is rotatable in a second direction to urge the scissor lift 12 into the lowered position having the top end 16 being spaced a minimum distance from the base 14.

The screw 20 has an exposed end 22 with respect to the scissor lift 12. The base 14 is positionable on a support surface 24 has the scissor lift 12 extending upwardly from the support surface 24. A fitting 26 is coupled to the screw 20 and the fitting 26 is positioned on the exposed end 22 of the screw 20. The fitting 26 has an outer surface 28 and the outer surface 28 has a plurality of intersecting sides 30 such that the fitting 26 has a hexagonal shape. In this way the fitting 26 can be engaged by a chuck 32 on a drill 34 thereby facilitating the drill 34 to rotate the screw 20 in the first direction or the second direction.

A panel 36 is coupled to the top end 16 of the scissor lift 12 and the panel 36 has a top surface 38 and a bottom surface 40. The bottom surface 40 rests on the top end 16 of the scissor lift 12. The panel 36 has a plurality of apertures 42 that each extends through the top surface 38 and the bottom surface 40. A support 44 is coupled to the panel 36 such that the support 44 is oriented to lie on a horizontal plane. In this way an overhead cabinet 46 can be positioned thereon thereby facilitating the scissor lift 12 to lift and lower the overhead cabinet 46 for installation. The overhead cabinet 46 may be an overhead cabinet in a kitchen or other type of cabinet that is mounted to a wall. The support 44 has a lower surface 48, an upper surface 50 and a perimeter edge 52 extending therebetween, and the perimeter edge 52 has a first lateral side 54 and a second lateral side 56.

The support 44 has a pair of tabs 58 that each extends downwardly from the lower surface 48. Each of the tabs 58 is aligned with a respective one of the first lateral side 54 and the second lateral side 56 of the perimeter edge 52. In this way each of the tabs 58 can be gripped for positioning the scissor lift 12 and the overhead cabinet 46. The lower surface 48 of the support 44 rests on the top surface 38 of the panel 36 having the panel 36 being centrally positioned on the lower surface 48. A plurality of fasteners 60 is provided each of the fasteners 60 is extendable through a respective one of the apertures 42 in the panel 36 and engages the support 44 for retaining the support 44 on the panel 36. Each of the fasteners 60 may comprise a screw 20 or other type of releasable fastener.

In use, the scissor lift 12 is positioned on the support surface 24, which may be a base cabinet, a tool cart or any other horizontal support surface that is located below the installation location of the overhead cabinet 46. The overhead cabinet 46 is placed on upper surface 50 of the support 44. The drill 34 is attached to the fitting 26 and the drill 34 is turned on to rotate the screw 20. In this way the scissor lift 12 raises the overhead cabinet 46 into position for installation. Thus, a single individual can lift and install an overhead cabinet 46 without having to manually lift the overhead cabinet 46.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the elements is present, unless the context clearly requires that there be only one of the elements.

I claim:

1. A cabinet lifting assembly being configured to lift overhead cabinets into position for installation, said assembly comprising:

a scissor lift being positionable between a lifted position and a lowered position, said scissor lift including a base, a top, a pair of scissors and a screw extending between said scissors;

a fitting being coupled to said screw wherein said fitting is configured to be engaged by a chuck on a drill thereby facilitating said screw to be rotated in said first direction or said second direction;

a panel being coupled to said top of said scissor lift;

a support being coupled to said panel such that said support is oriented to lie on a horizontal plane wherein said support is configured to have an overhead cabinet positioned thereon thereby facilitating said scissor lift to lift and lower the overhead cabinet for installation;

wherein each of said scissors extends between said base and said top, said screw being rotatable in a first direction to urge said scissor lift into said lifted position having said top being spaced a maximum distance from said base, said screw being rotatable in a second direction to urge said scissor lift into said lowered position having said top being spaced a minimum distance from said base, said screw having an exposed end with respect to said scissor lift, said base being positionable on a support surface having said scissor lift extending upwardly from the support surface;

said panel having a top surface and a bottom surface, said bottom surface resting on said top of said scissor lift, said panel having a plurality of apertures each extending through said top surface and said bottom surface; and wherein said support has a lower surface, an upper surface and a perimeter edge extending therebetween, said perimeter edge having a first lateral side and a second lateral side, said support having a pair of tabs each extending downwardly from said lower surface, each of said tabs being aligned with a respective one of said first lateral side and said second lateral side of said perimeter edge wherein each of said tabs is configured to be gripped for positioning said scissor lift and the overhead cabinet, each tab being planar and positioned parallel to said screw, each tab having a width less than a length of said first lateral side and said second lateral side, each tab being centered along said respective one of said first lateral side and said second lateral side, said lower surface of said support resting on said top surface of said panel having said panel being centrally positioned on said lower surface.

2. The assembly according to claim 1, said fitting is positioned on said exposed end of said screw, said fitting having an outer surface, said outer surface having a plurality of intersecting sides such that said fitting has a hexagonal shape.

3. The assembly according to claim 1, further comprising a plurality of fasteners, each of said fasteners being extendable through a respective one of said apertures in said panel and engaging said support for retaining said support on said panel.

4. A cabinet lifting assembly being configured to lift overhead cabinets into position for installation, said assembly comprising:

a scissor lift being positionable between a lifted position and a lowered position, said scissor lift including a base, a top, a pair of scissors and a screw extending between said scissors, each of said scissors extending between said base and said top, said screw being rotatable in a first direction to urge said scissor lift into said lifted position having said top being spaced a maximum distance from said base, said screw being rotatable in a second direction to urge said scissor lift into said lowered position having said top being spaced a minimum distance from said base, said screw having an exposed end with respect to said scissor lift, said base being positionable on a support surface having said scissor lift extending upwardly from the support surface;

a fitting being coupled to said screw, said fitting being positioned on said exposed end of said screw, said fitting having an outer surface, said outer surface having a plurality of intersecting sides such that said fitting has a hexagonal shape wherein said fitting is configured to be engaged by a chuck on a drill thereby facilitating said screw to be rotated in said first direction or said second direction;

a panel being coupled to said top of said scissor lift, said panel having a top surface and a bottom surface, said bottom surface resting on said top of said scissor lift, said panel having a plurality of apertures each extending through said top surface and said bottom surface;

a support being coupled to said panel such that said support is oriented to lie on a horizontal plane wherein said support is configured to have an overhead cabinet positioned thereon thereby facilitating said scissor lift to lift and lower the overhead cabinet for installation, said support having a lower surface, an upper surface and a perimeter edge extending therebetween, said perimeter edge having a first lateral side and a second lateral side, said support having a pair of tabs each extending downwardly from said lower surface, each of said tabs being aligned with a respective one of said first lateral side and said second lateral side of said perimeter edge wherein each of said tabs is configured to be gripped for positioning said scissor lift and the overhead cabinet, each tab being planar and positioned parallel to said screw, each tab having a width less than a length of said first lateral side and said second lateral side, each tab being centered along said respective one of said first lateral side and said second lateral side, said lower surface of said support resting on said top surface of said panel having said panel being centrally positioned on said lower surface; and a plurality of fasteners, each of said fasteners being extendable through a respective one of said apertures in said panel and engaging said support for retaining said support on said panel.

* * * * *